United States Patent [19]

Bigelow

[11] 4,380,289

[45] Apr. 19, 1983

[54] PAPERBOARD DISPENSER PACKAGE WITH REMOVABLE SCOOP PANEL

[75] Inventor: Stanley K. Bigelow, St. Joseph, Mo.

[73] Assignee: Champion International Corporation, Stamford, Conn.

[21] Appl. No.: 322,773

[22] Filed: Nov. 19, 1981

[51] Int. Cl.[3] ..... B65D 77/00

[52] U.S. Cl. ..... 206/216; 229/7 R; 220/410

[58] Field of Search ..... 206/216; 220/400, 402, 220/403, 404, 410; 229/20, 23 R, 7 R

[56] References Cited

U.S. PATENT DOCUMENTS

| | | | |
|---|---|---|---|
| 2,027,624 | 1/1936 | Bastow | 206/216 |
| 2,642,988 | 6/1953 | Freeman | 206/216 |
| 3,567,105 | 3/1971 | Mc Farlin | 206/216 |
| 3,640,447 | 2/1972 | Forbes, Jr. et al. | 206/216 |
| 4,298,157 | 11/1981 | DeVitano | 206/216 |

*Primary Examiner*—Joseph Man-Fu Moy

*Attorney, Agent, or Firm*—Evelyn M. Sommer

[57] ABSTRACT

A rectangular-shaped paperboard dispenser package is provided with inner and outer compartments, each compartment being erected from separate blanks. The outer surface of the inner compartment is in abutting relationship with the inner surface of the outer compartment on the erected package. One side panel of the outer compartment includes a removable scoop panel that can be erected to form a scoop for dispensing the contents of the package. Due to the dual compartment construction, the dispenser package retains its structural integrity after removal of the scoop panel from the outer compartment.

16 Claims, 5 Drawing Figures

PAPERBOARD DISPENSER PACKAGE WITH REMOVABLE SCOOP PANEL

BACKGROUND OF THE INVENTION

The subject invention relates to a new and improved paperboard dispenser package. More particularly, the invention relates to a rectangular-shaped tubular paperboard package that is designed to hold and store a relatively large volume of heavy material that will be dispensed therefrom and at least one wall of the package includes a panel which, without destroying the structural integrity of the package, can be removed and formed into a scoop for dispensing the contents of the package. The subject dispenser package could be used to accommodate pet foods, laundry detergents, grass seed, fertilizers, and the like.

In the past, packages for materials such as those listed above have included heavy duty paper sacks. The top edge of these paper sacks are opened by cutting, utilizing a tear tape built into the sack, or any number of other means. Once opened, the entire sack is lifted, and the material inside is dispensed by pouring into a suitable receptacle. This type of the prior art packaging had several disadvantages. First, it is difficult to keep the paper sack in a upright position, and often the open sack falls over and spills. Second, it is difficult to properly reseal the open paper sack. Therefore, for certain applications the contents are subject to spoilage. Third, the methods of dispensing the contents of the sack are undesirable. For example, the user can lift the entire sack and pour the contents out of an opening. This requires the user to lift a package which, because of its non-rigid walls, is difficult to handle. Furthermore, it is difficult to accurately gauge the amount of material to be poured from the package, and it is quite common to pour considerably more than needed. A second method of dispensing material from this type of container is to make a larger opening in the sack, and to remove the contents by hand with a separate tool (e.g., a cup). This approach also has several disadvantages. For example, a large opening in the top of the sack increases the potential for spillage described above. Also, the user is required to have a separate dispensing utensil. This separate utensil may be included within the package by the manufacturer, or may be obtained by the user. In either case it requires a separate cost and a separate manufacturing process.

Paperboard cartons that are used to store and dispense the material therein offer several advantages over the heavy duty paper sacks described above. Most significantly, they are easier to store and less likely to spill. However, the paperboard cartons of the prior art had several deficiencies as dispensers. For example, some of these paperboard cartons utilize an opening that can be cut into one of the upper corners of the carton just prior to use. The entire carton then can be lifted, and the contents thereof poured into a suitable receptacle by the user. This design however, requires the user to lift and manipulate a heavy package. Furthermore, as with the paper sack, it often is difficult for the user to estimate accurately the volume of contents that are being poured. As a result, the user frequently pours more or less than needed, and then must adjust for this initial miscalculation. Variations of this design include a metal spout incorporated into one of the side walls near the top. This metal spout however, does not overcome the difficulties just described, and does result in additional cost of manufacture.

A second variation of the paperboard carton utilizes a design in which the entire top of the carton is opened, and the materials therein are dispensed by hand. Although this design eliminates the pouring problems of the carton previously described, and the storage and spillage problems of the paper sacks, it requires the user to have a separate utensil for removing the contents of the carton. In some instances a separately manufactured scoop or cup, which may be made of plastic, is placed in the carton by the manufacturer. However, this utensil adds to the cost of the product.

Tops utilized with many of the latter type of cartons present problems in that after the initial opening they are not secured properly to the main body of the carton, or they require construction from a separate blank.

In view of the above, it is an object of the present invention to provide a paperboard container that facilitates carrying, storing and dispensing the materials included therein. Additionally, it is an object of the present invention to provide a sturdy carton structure. It is a further object of the present invention to provide a package from which materials may be dispensed without requiring the user to lift or handle the entire package, and that can be securely reclosed after initial opening. Finally, it is an object of the present invention to provide a dispenser package that will include an integral scoop thereby minimizing the need of the user to rely on separately manufactured equipment to properly utilize the package, and that will achieve all of the above with a minimum number of blanks.

The paperboard dispenser package that achieves these objectives is constructed from two blanks that are dimensioned and foldably connected to form inner and outer compartments. In its final form, the outer surface of the inner compartment and the inner surface of the outer compartment are in abutting relationship. The inner compartment includes side and bottom walls, and the outer compartment includes side, bottom and top walls. As described more fully below, the top and a portion of each side of the outer compartment function as a lid to the completed structure by sliding over the upper part of the inner compartment's side walls. This lid may be constructed to include a built-in carrying handle. The outer compartment also can be designed to include a tear tape that will enable easy removal of the lid from the remainder of the outer compartment. In certain applications, such as pet foods, the lid may be inverted after removal, and used as a bowl for serving the product.

The dual-compartment design provides a sturdy construction, and also enables one or more small removable panels to be formed in the outer compartment. The panels may be removed from the dispenser package without destroying the structural integrity thereof, and then may be erected to form one or more separate structures that can be used in conjunction with the dispenser pack. In particular, the removal panel is designed to be erected into a scoop to dispense the contents of the pack.

Further objects and advantages of the invention will become apparent from a reading of the following detailed description taken in conjunction with the drawings.

DETAILED DESCRIPTION OF THE INVENTION

Figure 1:
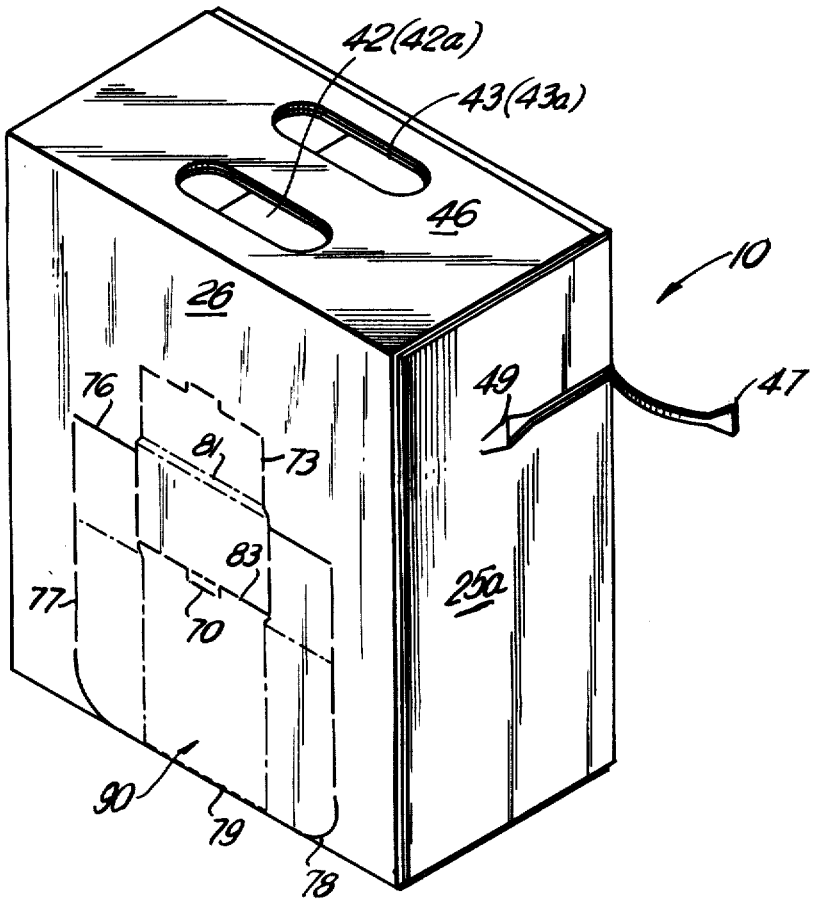
FIG. 1 is a perspective view of an erected rectangular-shaped paperboard dispenser package.
Figure 2:
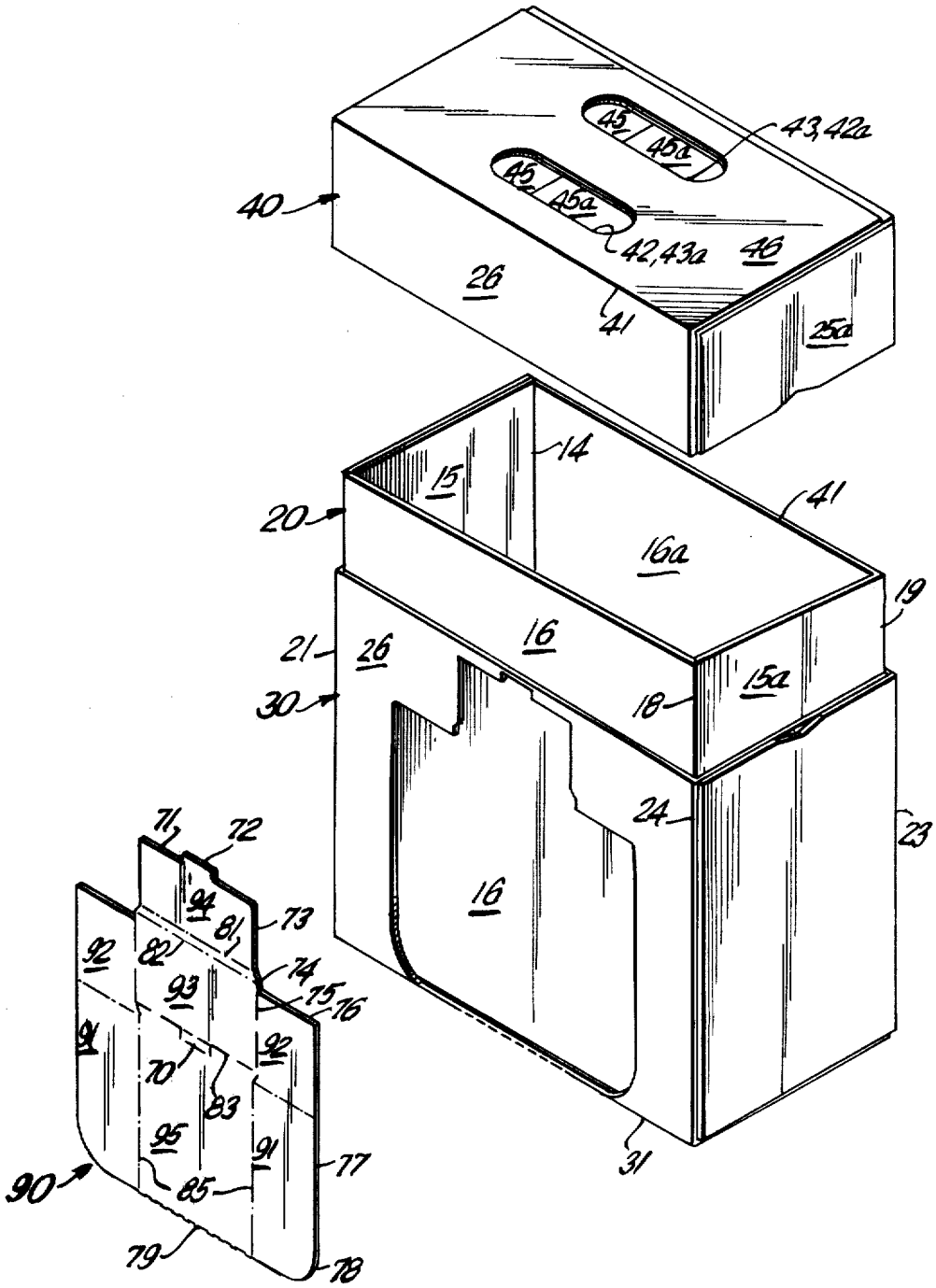
FIG. 2 is an exploded perspective view wherein a removable scoop panel and the lid are displaced from the remainder of the carton.

Referring to FIG. 1, the dispenser package of the subject invention, designated as number 10, is shown in its erected, unopened form. The inner compartment of the package is concealed from view by the outer compartment in the perspective shown in FIG. 1. The outer compartment includes a bottom surface (not shown) and a top surface. It also includes four substantially rectangular side panels, 25 and 26 which are shown, and 25a and 26a which are not shown. An elongated tear tape 47 is incorporated in the side panels and extends transverse thereto. The tear tape 47 is easily removable to enable separation of the outer compartment, as illustrated in FIG. 2. Side panel 26 includes a scoop panel 90 which is disposed in the lower portion thereof and is removable from the outer compartment.

Figure 3:
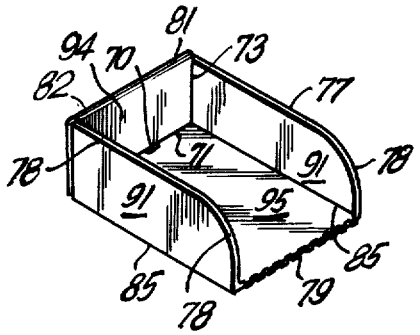
FIG. 3 is a perspective view of the removable scoop panel of the outer compartment constructed to form a scoop.

FIG. 2 is an exploded perspective view which shows the top portion of the outer compartment 40 separated from the bottom portion of the outer compartment 30, thereby exposing the inner compartment 20. In applications with dog food, the top of the outer compartment 40 may be inverted and used as a dish to serve the dog food. With the top 40 of the outer compartment separated from the bottom 30 of the outer compartment, the inner compartment 20 is exposed to view. Inner compartment 20 includes a bottom surface not shown, but no top surface, and is constructed to fit tightly within the outer compartment. FIG. 2 also shows the scoop panel 90 removed from side panel 26. It is clear from FIG. 2 that the dispenser package retains its structural integrity after removal of scoop panel 90 from side panel 26. Scoop panel 90 may be constructed to form a scoop as shown in FIG. 3, and as described more fully below. The constructed scoop as shown in FIG. 3 may be used to dispense the material from the dispenser package.

Figure 4:
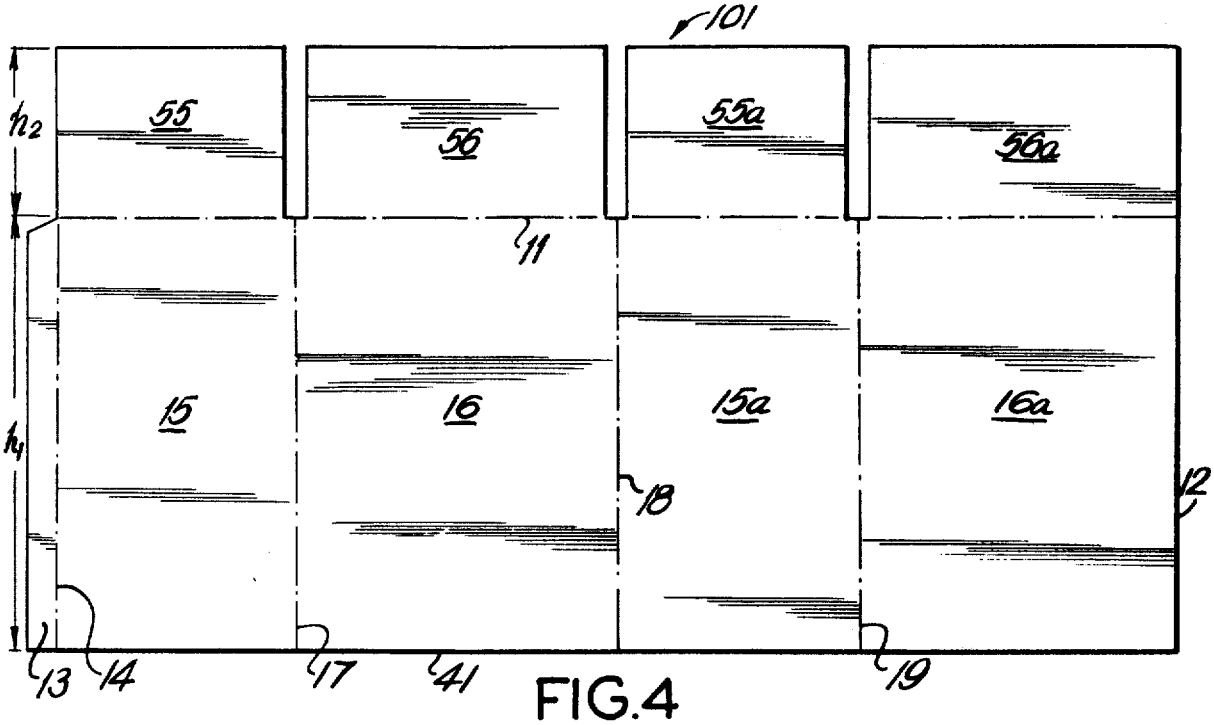
FIG. 4 is a plan view of the paperboard blank for forming the inner compartment of the rectangular-shaped paperboard dispenser package.

Turning now to FIG. 4, the inner compartment is formed from a single blank 101. The blank 101 includes four rectangular side panels 15, 15a, 16, and 16a, all of height "$h_1$" and foldably connected to one another along their longitudinal axes at fold lines 17, 18, and 19. Adjacent to side panel 15, at edge 14 is a gluing flap 13, adhesively attachable to side panel 16a at edge 12. In the preferred embodiment, the dispenser package is designed to have a rectangular configuration when viewed from the top. As a result, side panels 15 and 15a are of equal width, but are narrower in width than side panels 16 and 16a. Side panel 16a is slightly narrower than side panel 16 to insure that edge 12 does not extend beyond the fold line 14 between side panel 15 and glue flap 13 on the completed inner compartment.

Foldably connected to the bottom edge 11 of each side panel are substantially rectangular flaps 55, 56, 55a and 56a. All four flaps are of equal height "$h_2$." Height "$h_2$" is slightly less than the width of panels 15 and 15a so that when flaps 56 and 56a are folded over they do not extend past side panels 16a and 16 respectively. Furthermore, the dimensions of the structure are selected so that the height "$h_2$" of the flaps is slightly more than one half the width of panels 16 and 16a, so that when flaps 55 and 55a are folded they overlap slightly, thereby forming a continuous bottom surface.

The inner compartment is formed by attaching gluing flap 13 to side panel 16a at edge 12, thus forming a rectangular tube. Flaps 55 and 55a are then folded inwardly into substantially perpendicular alignment with the side panels. Due to the relationship between the height of the flaps and the width of panels 16 and 16a, as described above, flaps 55 and 55a when folded into the position described above form a continuous bottom surface of the inner compartment. Finally, flaps 56 and 56a are folded alternatively on top of the surface formed by flaps 55 and 55a and are secured to one another by any suitable means such as gluing. Flaps 56 and 56a each extend essentially the entire width of panels 15, and 15a. Thus, the inner compartment has a bottom consisting of three plies of the paperboard material.

The blank 102 for the outer compartment (FIG. 5) includes four rectangular side panels 25, 26, 25a and 26a foldably connected to one another along fold lines 21, 22, and 23. The height "$h_3$" of all four side panels is equal, and is greater than the height "$h_1$" of the side panels of the inner compartment. Gluing flap 28 is foldably connected to side panel 26 at fold line 24. Side panels 26 and 26a are of substantially equal width and are wider than side panels 25 and 25a. In final erected form, panels 16 and 16a of the inner compartment abut panels 26 and 26a of the outer compartment. Similarly, in final erected form, panels 15 and 15a of the inner compartment abut panels 25 and 25a of the outer compartment. Thus, panels 26 and 26a are constructed to be slightly wider than panels 16 and 16a, and panels 25 and 25a are constructed to be slightly wider than panels 15 and 15a. This dimensioning enables the inner compartment to slide within the outer compartment. Panel 25a is slightly narrower than panel 25 to insure that edge 29 does not extend beyond fold line 24 between panel 26 and gluing flap 28 when the outer compartment is finally constructed.

Substantially rectangular bottom end flaps 35, 35a, 36 and 36a and top end flaps 45, 45a, 46 and 46a are foldably attached to the bottom and top edges 31 and 41 respectively of the side panels. The height "$h_4$" of the end flaps on the outer compartment is slightly greater than the height "$h_2$" of the end flaps on the inner compartment, because of the need for the outer compartment to close around the inner compartment. Outer compartment end flap height "$h_4$" also is slightly less than the width of panel 25 so that when end flaps 36, 36a, 46 and 46a are folded over, they do not extend past side panels 26 and 26a. The height "$h_4$" of the end flaps is also slightly more than one-half the width of panels 26 and 26a. By this arrangement, when end flap pair 35 and 35a or pair 45 and 45a are folded inwardly, they form a continuous surface.

Top end flap 46 includes cutouts 42 and 43. Similarly, top end flap 46a includes cutouts 42a and 43a. Although a variety of cutout shapes would be acceptable, in the preferred embodiment, the cutouts are generally elongated with rounded ends. The longitudinal axis of each cutout is parallel to the longitudinal axes of end flaps 46 and 46a. Each cutout should be symmetrical about the transverse axis of its end flap. The strip of paperboard between each cutout on each end flap should be wide enough so that a person could easily insert his or her forefingers in one cutout and a thumb in the other cutout on the same end flap thereby utilizing the strip of paperboard between the cutouts as a carrying handle for the erected dispenser package. The distance from fold line 41 to the lower edge of the cutouts 42 and 43 on end flap 46 is slightly less than the distance from fold line 41 to the lower edge of the cutouts 42a and 43a on end flap 46a. This minor lack of symmetry assures that the cutouts 42 and 43a will be aligned with one another on the constructed carton, as will cutouts 43 and 42a.

Extending parallel to bottom edge 31 and top edge 41 across all four side panels and the gluing flap is the tear tape 47, or other similar means, that will insure a secure carton during shipping and storage, but will enable the user to open the carton for use without relying on other tools. The starting point 49 for the tear tape 47 is shown in side panel 25a. The user will merely grasp the tear tape 47 at its starting point in side panel 25a and pull it around the entire carton, thereby disengaging the top portion of the outer compartment from the bottom portion of the outer compartment. In applications with pet food, the removal top portion 40 of the container may be inverted to function as a serving dish.

Figure 5:
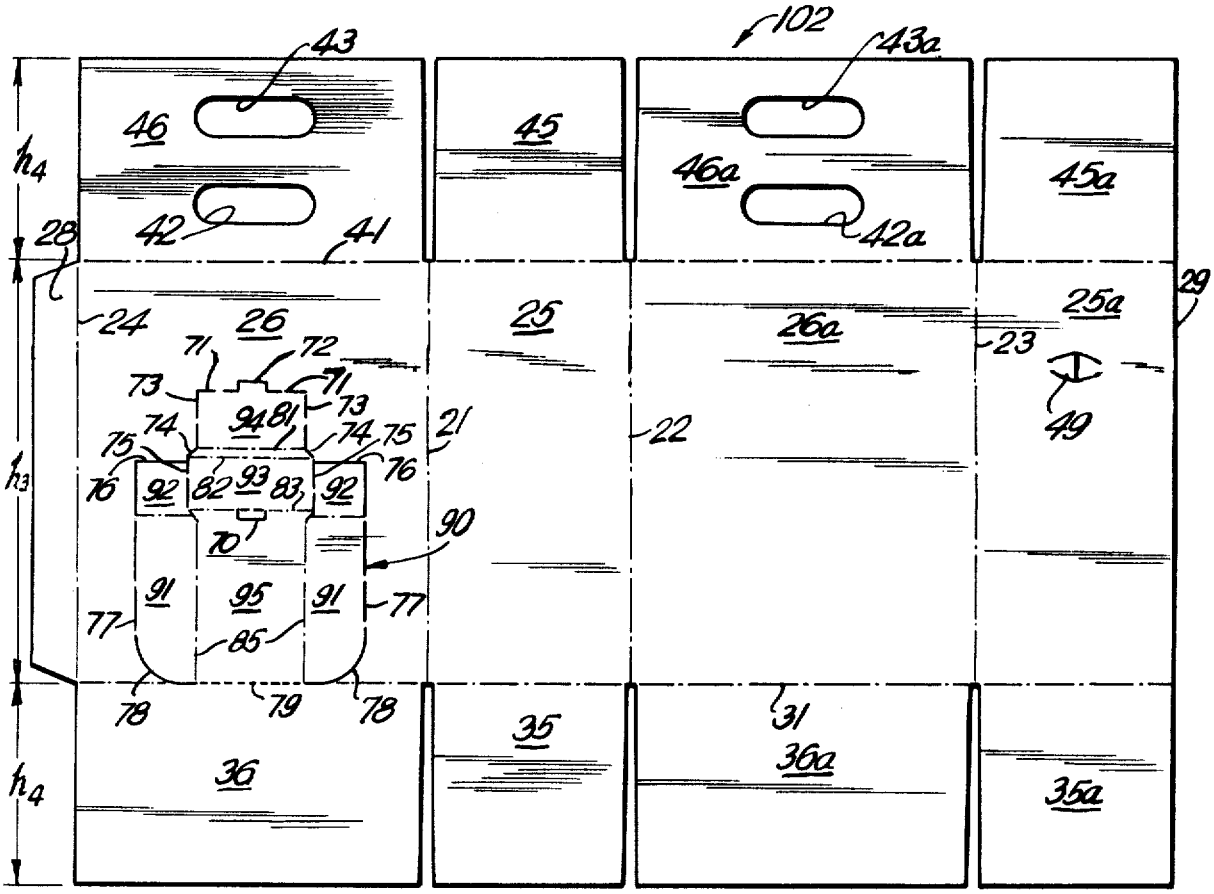
FIG. 5 is a plan view of the paperboard blank for forming the outer compartment of the rectangular shaped paperboard dispenser package.

A series of perforations defines a removable scoop panel 90 in side panel 26 below the tear tape perforation 47. Perforation 71 of scoop panel 90 is parallel to and slightly below tear tape 47 and is centrally located between fold lines 18 and 19. The length of perforation 71 defines the width of the bottom surface 95 of the scoop, and is depicted in FIG. 5 as approximately ⅓ the width of side panel 26. Centrally disposed on perforation 71 and extending toward tear tape 47 is tab 72. Extending perpendicularly away from tear tape 47 from each end of perforation 71 are perforations 73 which define the height of the walls of the scoop. Each perforation 73 ends at perforation 74 which extends diagonally a short distance away from both tear tape 47 and the center of side panel 26. Each perforation 74 terminates at a perforation 75 which is parallel to perforation 73 and to each other. Perforations 75 are slightly longer than perforations 73. Perforations 76 each extend perpendicularly from near the top of perforations 75 away from the center of side panel 26 for a distance approximately equal to the length of perforations 73. Perforations 77 extend perpendicularly from the ends of perforations 76 that are away from perforations 75 toward bottom edge 31. The ends of perforations 77 nearest bottom edge 83 meet arcuate perforations 78 which curve from perforations 77 toward the center of side panel 26. The lower ends of arcuate perforations 78 each intersect at perforation 79 which is colinear with bottom edge 31 of side panel 26.

Fold line 81 of scoop panel 90 is parallel to perforation 71 joining the intersections of perforations 73 and 74. The area 94 defined by perforations 71 and 73 and fold line 81 forms the inner panel of the rear wall or grip of the erected scoop. Fold line 82 is parallel to fold line 81 joining the intersections of perforations 74 and 75. Fold line 83 is parallel to both fold lines 81 and 82, joining the lower ends of perforations 75. The area 93 defined by perforations 75 and fold line 82 and 83 forms the outer panel of the rear wall or grip of the erected scoop. Centrally located on fold line 83 is U-shaped perforation 70 which forms a notch on the erected scoop into which tab 72 is inserted. Fold lines 84 extend parallel to fold lines 81, 82 and 83 from perforation 77 to a point in line with perforation 73. Area 92 defined by fold line 84 and perforations 75, 76 and 77 are flaps about which areas 93 and 94 fold. Fold lines 85 are colinear with perforations 73, and extend from fold line 84 to perforation 79. Areas 91 defined by fold lines 83 and 84 and by perforations 77 and 78 define the side walls of the scoop. Finally, area 90 defined by fold lines 83 and 85 and perforation 79 forms the bottom surface of the scoop.

The outer compartment is erected by attaching gluing flap 28 to side wall 25a at edge 29, thereby forming a rectangular tube. End flaps 35 and 35a are then folded inwardly into essentially perpendicular alignment with the side panels. As mentioned above, the height "$h_4$" of the end flaps is slightly more than one half the width of side panels 26 and 26a. Therefore, in their folded position, end flaps 35 and 35a will overlap thereby forming a continuous bottom surface for the outer compartment. End flaps 36 and 36a are then folded alternatively inwardly thereby forming a three-ply bottom surface for the outer compartment. The end flaps may be secured in this position by any suitable means such as gluing.

At this point the inner compartment may be slid into the outer compartment. The resultant structure then may be filled with an appropriate material for marketing (e.g., pet food). The top of the outer compartment is then closed. This is accomplished by first folding top end flaps 45 and 45a inwardly into a perpendicular alignment with side panels. As mentioned before, the height "$h_4$" of the end flaps is slightly more than one half the width of the side panels 26 and 26a. Therefore, folded end flaps 45 and 45a will define a continuous flat surface on the top of the carton. End flap 46 and then end flap 46a are folded inwardly in a similar manner, and are secured appropriately to one another. By this arrangement, cutouts 42 and 43a are aligned with one another as are cutouts 42a and 43. The strips between these pairs of aligned cutouts will define a double-ply carrying handle.

The erected structure is shown in perspective view in FIG. 1. The user or purchaser of the dispenser package may open the carton by grasping the tear tape 47 at its starting point 49 on side panel 25a, and pulling it entirely around the edge of the carton back to its starting point on side panel 25a. The top of the dispenser package may then be removed.

In applications with pet food, the top may be inverted and used to serve the contents of the dispenser package to the pet.

The scoop panel 90 is removed from the outer compartment 30 by disengaging it along its continuous perforation. Because of the dual compartment construction of the dispenser package, the package remains structurally intact and capable of holding its contents after removal of the scoop panel from the outer compartment. This feature is shown more clearly in FIGS. 2 and 3. The scoop panel is further servered along perforation 75, thereby forming rectangular flaps 92. The side walls 91 of the scoop panel are folded upward along fold lines 85. Rectangular flaps 92 are folded inwardly toward one another along fold line 84. Surfaces 93 and 94 of the scoop panel then are folded upwardly along fold line 83, thereby causing a severance at the U-shaped perforation 70, and in the process creating a notch at 70. Surface 94 of the scoop panel then is folded inwardly and downwardly along fold lines 81 and 82 over rectangular flaps 92, and tab 72 is inserted into the notch previously formed at 70. The insertion of tab 72 into the notch at 70 securely holds the side walls 91 into a structurally sturdy scoop as shown in FIG. 3. The scoop then can be used to remove the contents from the dispenser package and if appropriate, placed into the inverted cover.

Accordingly, there is provided a new and improved rectangular-shaped paperboard dispenser package which achieves all the objectives described above.

In particular, the subject invention provides a sturdy carton that facilitates carrying, storing and dispensing the materials that will be stored in it. The subject carton is sturdy because of its dual wall construction and its two triple-ply bottoms disposed on top of one another. The subject carton has a built-in handle that facilitates carrying, and it is well adapted to storage because of its rectangular configuration and its recloseable lid. Finally, it facilitates dispensing its contents because of the scoop that can be erected from the scoop panel in the side panel of the outer compartment.

The subject invention, and many of its intended advantages will be understood from the foregoing description, and it will be apparent that various changes may be made in the form and construction of the subject dispenser package without departing from the spirit and scope of the invention as defined by the following claims.

What is claimed is:

1. A rectangular-shaped paperboard dispenser package comprising:

an inner compartment formed from first and second opposed pairs of substantially rectangular, upstanding inner side panels that are alternatively foldably connected, each of said inner side panels including a horizontally disposed, substantially rectangular inner bottom flap foldably connected to the bottom edge thereof, said inner bottom flaps being folded to form the bottom surface of said inner compartment; and an outer compartment formed from first and second opposed pairs of substantially rectangular, upstanding outer side panels that are alternatively, foldably connected, each outer side panel including a horizontally disposed, substantially rectangular outer bottom flap foldably connected to the bottom edge thereof, said outer bottom flaps being folded to form the bottom of said outer compartment, each outer side panel further including a horizontally disposed substantially rectangular outer top flap foldably connected to the top edge thereof and folded to form the top of said outer compartment, one outer side panel including a removable scoop panel for forming a scoop, said scoop panel comprising a substantially rectangular bottom surface, a first side wall foldably connected to a first edge of said bottom surface, a second side wall having substantially the same configuration as said first side wall and being foldably connected to a second edge of said bottom surface, wherein the second edge of the bottom surface is opposite the first edge thereof, first and second substantially rectangular end flaps foldably connected to said first and second side walls, respectively, said foldable connection between said side walls and said end flaps being substantially perpendicular to said foldable connection between said side walls and said bottom surface, a substantially rectangular exterior end wall foldably connected to a third edge of said bottom surface and disposed between said end flaps, a substantially rectangular interior end wall foldably connected to the edge of said exterior end wall opposite said bottom surface, said end walls being adapted to foldably engage said end flaps to secure said end flaps in perpendicular disposition to both said bottom surface and said side walls for forming said scoop panel into a scoop.

2. A rectangular-shaped paperboard dispenser package as in claim 1, wherein a continuous perforation in one said outer side panel defines said removable scoop panel.

3. A rectangular-shaped paperboard dispenser package as in claim 2, further comprising a tab centrally disposed on the edge of said interior end wall opposite the edge thereof connected to said exterior end wall, and wherein said bottom surface of the scoop panel includes a notch centrally disposed thereon and adjacent to said exterior end wall, said tab being adapted for insertion in said notch to lock said scoop into the erected form.

4. A rectangular-shaped paperboard dispenser package as in claim 3 wherein the edge of each said side wall of said scoop panel opposite said bottom surface and the edge of each said side wall of said scoop panel opposite said end flaps intersect to form arcuate corners.

5. A rectangular-shaped paperboard dispenser package as in claim 4, wherein a tear tape is incorporated in said outer side panels and extends parallel to the top and bottom edges of said outer compartment between said scoop panel and the top edge of said inner compartment, such that removal of said tear tape results in the portion of said outer compartment above the tear tape being separable from the portion of said outer compartment below said tear tape.

6. A rectangular-shaped paperboard dispenser package as in claim 1 wherein two opposed outer top flaps each contain two cutouts, such that the cutouts of one opposed outer top flap are aligned with the cutouts of the other opposed outer top flap, and such that the section of the outer top flaps between said cutout portions forms a carrying handle for said dispenser package.

7. A rectangular-shaped paperboard dispenser package as in claim 6 wherein each said cutout is elongated.

8. A rectangular-shaped paperboard dispenser package as in claim 7 wherein the opposed ends of each elongated cutout is arcuate.

9. A pair of paperboard blanks for forming a rectangular-shaped dispenser package comprising:

a first blank for forming an inner compartment, said first blank comprising an inner side wall formed from first and second pairs of substantially rectangular inner side panels that are alternatively, foldably connected, an inner gluing flap foldably connected to an inner side panel at one end of said first blank, said inner gluing flap attachable to said inner side panel at opposite end of said blank, each inner side panel including a substantially rectangular inner bottom flap foldably connected to the bottom edge thereof; and a second blank for forming an outer compartment, said second blank comprising first and second pairs of substantially rectangular outer side panels that are alternatively, foldably connected, an outer gluing flap foldably connected to an outer side panel at one end of said blank, said outer gluing flap attachable to the outer side panel at the opposite end of said blank, each outer side panel including substantially rectangular outer top and outer bottom flaps foldably connected to the top and bottom edges thereof respectively, one outer side panel of said second blank including a removable scoop panel for forming a scoop, said scoop panel comprising a substantially rectangular bottom surface, a first side wall foldably connected to a first edge of said bottom surface, a second side wall having substantially the same configuration as said first side wall and being foldably connected to a second edge of said bottom surface, wherein the second edge of the bottom surface is opposite the first edge thereof, first and second substantially rectangular end flaps foldably connected to first and second said side walls respectively, said foldable connection between said side walls and said end flaps being substantially perpendicular to said foldable connection between said side surfaces and said bottom surface, a substantially rectangular exterior end wall foldably connected to a third edge of said bottom surface and disposed between said end flaps, a substantially rectangular interior end wall foldably connected to the edge of said exterior end wall opposite said bottom surface, said end walls being adapted to foldably engage said end flaps to secure said end flaps in perpendicular disposition to both said bottom surface and said side walls for forming said scoop panel into a scoop.

10. A pair of paperboard blanks for a rectangular-shaped dispenser package as in claim 9, wherein a continuous perforation in one said outer side panel of said second blank defines said removable scoop panel.

11. A pair of paperboard blanks for a rectangular-shaped dispenser package as in claim 10 wherein said scoop panel of said second blank further comprises a tab centrally disposed on the edge of said interior end wall opposite the edge thereof connected to said exterior end wall, and wherein said bottom surface of said scoop panel includes a notch centrally disposed thereon and adjacent to said exterior end wall.

12. A pair of paperboard blanks for a rectangular-shaped dispenser package as in claim 11, wherein the corner of each said side wall of said scoop panel formed by the edge thereof opposite said bottom surface and the edge thereof opposite said end flaps is arcuate.

13. A pair of paperboard blanks for a rectangular-shaped dispenser package as in claim 12 wherein a tear tape is incorporated in said side panels and extends parallel to the top and bottom edges of said second blank above said scoop panel, said tear tape extending across all side panels and said gluing flap of said second blank such that the portion of said second blank above said tear tape is separable from the portion of said second blank below said tear tape.

14. A pair of paperboard blanks for a rectangular-shaped dispenser package as in claim 9 wherein two opposed outer top flaps of said second blank each include two cutout portions disposed so that the cutout portions on one outer top flap are aligned with the cutout portions of the other outer top flap on the erected carton.

15. A pair of paperboard blanks for a rectangular-shaped dispenser package as in claim 14 wherein said cutout portions are elongated with rounded ends.

16. A rectangular-shaped paperboard dispenser package comprising:

an inner compartment formed from first and second opposed pairs of substantially rectangular, upstanding inner side panels that are alternatively foldably connected, each of said inner side panels including a horizontally disposed, substantially rectangular inner bottom flap foldably connected to the bottom edge thereof, said inner bottom flaps being folded to form the bottom surface of said inner compartment; and an outer compartment formed from first and second opposed pairs of substantially rectangular, upstanding outer side panels that are alternatively, foldably connected, each outer side panel including a horizontally disposed, substantially rectangular outer bottom flap foldably connected to the bottom edge thereof, said outer bottom flaps being folded to form the bottom of said outer compartment, each outer side panel further including a horizontally disposed substantially rectangular outer top flap foldably connected to the top edge thereof and folded to form the top of said outer compartment, one outer side panel including a removable scoop panel having a plurality of fold lines and cut lines whereby said scoop panel may be removed from said outer side panel of said outer compartment and folded along said fold lines to form a scoop for aiding in dispensing of the contents of said dispenser package.

* * * * *